US008161937B2

(12) United States Patent
Nagao et al.

(10) Patent No.: US 8,161,937 B2
(45) Date of Patent: Apr. 24, 2012

(54) AIR INTAKE DEVICE OF ENGINE

(75) Inventors: Tokinari Nagao, Shizuoka (JP); Takashi Ashida, Shizuoka (JP); Atsushi Sawabuchi, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 772 days.

(21) Appl. No.: 12/353,360

(22) Filed: Jan. 14, 2009

(65) Prior Publication Data

US 2009/0223478 A1 Sep. 10, 2009

(30) Foreign Application Priority Data

Mar. 5, 2008 (JP) ..... 2008-054590

(51) Int. Cl.
*F02M 3/06* (2006.01)

(52) U.S. Cl. ..... 123/339.1; 123/339.27

(58) Field of Classification Search ..... 123/337, 123/339.1, 339.14, 339.27, 585; 251/305
See application file for complete search history.

(56) References Cited

U.S. PATENT DOCUMENTS 5,687,695 A 11/1997 Tsukamoto et al.
6,814,051 B2 * 11/2004 Suzuki ..... 123/337

OTHER PUBLICATIONS

Nagao et al.; "Engine Intake System"; U.S. Appl. No. 12/353,350, filed Jan. 14, 2009.

* cited by examiner

*Primary Examiner* — Noah Kamen
(74) *Attorney, Agent, or Firm* — Keating & Bennett, LLP

(57) ABSTRACT

An air intake device of an engine includes a throttle body provided in an intake passage of an engine, a bypass passage arranged to connect an upstream side and a downstream side of a throttle valve disposed in the throttle body, an idle number-of-revolutions control device that is disposed in the bypass passage and that controls the quantity of air passing through the bypass passage and flowing into the downstream side of the throttle valve according to the state of the engine, and a water collection portion that is disposed on the upstream side of the idle number-of-revolutions control device in the bypass passage and that is constructed so as to include a space portion connecting with the bypass passage. This structure enables smooth operation of the idle number-of-revolutions control device and prevents damage thereto caused by water in a bypass passage.

9 Claims, 5 Drawing Sheets

AIR INTAKE DEVICE OF ENGINE

BACKGROUND OF THE INVENTION

1. Field of the Invention

The present invention relates to an air intake device of an engine.

2. Description of the Related Art

A conventional structure includes an idle number-of-revolutions control device that is fitted to a throttle body and controls an idle number of revolutions of an engine to a target number of revolutions according to the state of the engine. For example, an idle number-of-revolutions control device disclosed in Japanese Unexamined Patent Publication No. 9-42119 has a water collection portion formed therein and can temporarily store dew condensed in the throttle body and water droplets from air cleaner piping in the water collection portion.

In the device disclosed in Japanese Unexamined Patent Publication No. 9-42119, the water collection portion is arranged on the downstream side of the idle number-of-revolutions control device. The idle number-of-revolutions control device has a valve body built in an air flow passage extending from an air cleaner, the valve body being operated by a proportion type solenoid. Thus, there is a possibility that moisture from the air cleaner will adhere to the valve body and will freeze up, and in that case, a problem is caused in that the idle number-of-revolutions control device will not smoothly operate.

SUMMARY OF THE INVENTION

In order to overcome the problems described above, preferred embodiments of the present invention provide an air intake device for an engine that ensures smooth operation of an idle number-of-revolutions control device.

According to a preferred embodiment of the present invention, an air intake device includes a throttle body disposed in an intake passage of an engine, a bypass passage that connects an upstream side and a downstream side of a throttle valve disposed in the throttle body, an idle number-of-revolutions control device that is disposed in the bypass passage and that is arranged to control the quantity of air passing through the bypass passage and flowing into the downstream side of the throttle valve according to the state of the engine, and a water collection portion that is disposed on the upstream side of the idle number-of-revolutions control device in the bypass passage and that includes a connection portion arranged to connect to the bypass passage.

According to a preferred embodiment of the present invention, the water collection portion is arranged on the upstream side of the idle number-of-revolutions control device, so that water in the bypass passage is collected before the idle number-of-revolutions control device. Thus, the water collection portion is arranged to prevent moisture from being frozen to the idle number-of-revolutions control device in cold weather.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

First Preferred Embodiment

Figure 1:
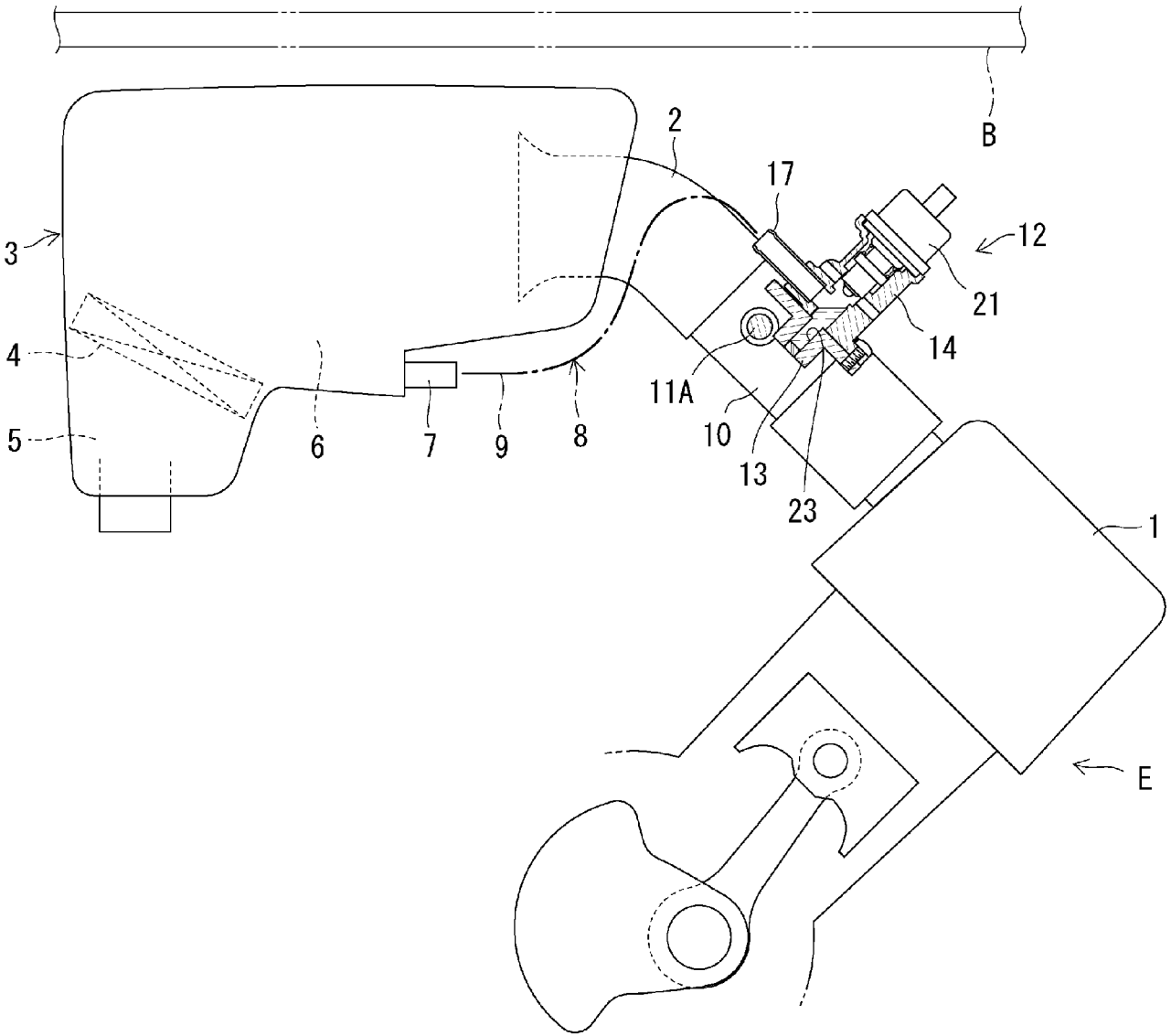
FIG. 1 is a front view illustrating an entire layout of an air intake device according to a first preferred embodiment of the present invention.

A first preferred embodiment of the present invention will be described with reference to FIG. 1 to FIG. 3. FIG. 1 shows the main portion of an air intake device for use in, for example, an engine of a snowmobile. A vehicle of this preferred embodiment is preferably mounted with a four-cylinder engine E arranged in parallel to a direction perpendicular to the surface of FIG. 1. One end side of each intake pipe 2 is connected to the cylinder head 1 of each cylinder, and the other end side of each intake pipe 2 is connected to an air cleaner 3 arranged forward of the engine E. The entire engine including the air cleaner 3 is housed in an engine department and is covered with a bonnet B (cover) that can be opened and closed from above.

The air cleaner 3 has its interior partitioned into two chambers by a filter element 4. One chamber is a dirty side chamber 5 into which outside air is taken, and the other chamber is a clean side chamber 6 into which clean air filtered through the filter element 4 is introduced, and the end portion of the intake pipe 2 is connected to the clean side chamber 6 in a protruding manner. A connection pipe 7 protrudes from the side surface, to which the intake pipe 2 is connected, of the bottom portion of this clean side chamber 6 and has the upstream end portion of a bypass pipe 9 connected thereto, the bypass pipe 9 defining a portion of a bypass passage 8.

A throttle body 10 is interposed in the middle of the intake pipe 2 and defines a portion of an intake passage 10A extending from the air cleaner 3 to the engine E. The throttle body 10 is arranged in a position slightly inclined downward and rearward with respect to a front and rear direction of the vehicle. In the interior of the throttle body 10, a throttle valve 11 is fitted to a support shaft 11A so as to be turned around the support shaft 11A, and can open and close the intake passage 10A in the interior in association with the operation of the throttle. Although not shown in the drawing, the opening of the throttle valve 11 is detected by a throttle opening sensor and its detection signal is inputted to an engine control unit (ECU) (not shown).

The throttle body 10 is preferably provided for each cylinder in this preferred embodiment. The throttle bodies 10 are preferably constructed to have the following unit structure: two throttle bodies 10 integrally formed as one set of throttle bodies 10, and two sets of throttle bodies 10 coupled to each other by a joining member (not shown); thus, a unit structure is produced in which four throttle bodies 10 are arranged in parallel or substantially parallel as a whole.

One of the two sets of throttle bodies 10 is provided with an idle number-of-revolutions control device 12. A lower housing 13 is formed integrally with a portion bridging between the throttle bodies 10 in this one set of throttle bodies 10, and the idle number-of-revolutions control device 12 is fitted in the lower housing 13 in a position protruding in a direction perpendicular or substantially perpendicular to the axial line of the throttle body 10, in other words, in an upward position slightly inclined rearward with respect to the front and rear direction of the vehicle.

The idle number-of-revolutions control device 12 introduces air from the air cleaner 3 to the downstream side of the throttle valve 11 in each of the throttle bodies 10 so as to bypass the intake pipe 2, thereby optimizing the quantity of air corresponding to the state of the engine at the time of the idle operation and of supplying the air to each cylinder.

The idle number-of-revolutions control device 12 has an upper housing 14 having a substantially circular cylinder shape and has a flange portion 14A integrally provided at its lower end in a projecting manner, the flange portion 14A being fitted to the lower housing 13. The flange portion 14A has a seal ring 15 fitted in the lower surface thereof, and when the idle number-of-revolutions control device 12 is fitted to the lower housing 13 with screws, for example, the sealing performance between the flange portion 14A and the lower housing 13 can be ensured by the seal ring 15. A fitting hole 16 is formed in the upper housing 14 along an axial direction thereof so as to pass to the outside. The upper housing 14 has an inflow pipe 17 fitted thereto in a manner protruding outward in the radial direction of the fitting hole 16, and the inflow pipe 17 has the downstream end portion of the bypass piping 9 connected thereto. The inflow pipe 17 connects with the interior of the fitting hole 16 and can introduce the clean air (bypass air) from the air cleaner 3 into the idle number-of-revolutions control device 12 through the bypass piping 9.

The upper housing 14 preferably has four outflow passages 19, for example, formed therethrough so as to extend in the radial direction from the through hole 16, the four outflow passages 19 preferably being arranged at intervals of nearly 90 degrees, for example, and connecting with the downstream sides of the throttle valves 11 in the bores of the corresponding throttle bodies 10. In this manner, the bypass passage 8 for supplying the bypass air from the air cleaner 3 to the downstream side of the throttle valve 11 in the throttle body 10 is defined by a route passing the bypass piping 9, the inflow pipe 17, the fitting hole 16, and the respective outflow passages 19 and extending to the downstream side of the throttle valve 11 in the throttle valve 10.

The upper housing 14 has an idle number of revolutions control valve (hereinafter referred to as an "ISC valve 21") fitted thereinto from the upper end side of the fitting hole 16. This ISC valve 21 has a plunger 22 arranged to be moved along the axial direction of the fitting hole 16 by a stepping motor, for example. The position of the plunger 22 is controlled by the stepping motor and hence the opening of each of the respective outflow passages 19 is controlled, whereby the quantity of air to be supplied to the downstream side of each throttle valve 11 at the time of an idle operation can be controlled. Here, the stepping motor of the ISC valve 21 has its motion controlled by the engine control unit.

The lower housing 13 fitted with the idle number-of-revolutions control device 12 has a water collection portion 23 disposed coaxially with the fitting hole 16. The water collection portion 23, in this preferred embodiment, is arranged so as to pass through the lower housing 13 along the axial direction and has a plug 24 fitted therein from a lower surface side, thereby being sealed. The position at which the water collection portion 23 is disposed is a position lower in the vertical direction with respect to a portion in which the air entering along the radial direction into the fitting hole 16 from the inflow pipe 17 changes its direction to the axial direction toward the ISC valve 21. In other words, the water collection portion 23 is constructed so as to be arranged outside a region through which the bypass air passes in a state where the water collection portion 23 connects with the bypass passage 8. Thus, even if there is caused an event in which water is collected in the bypass passage 8, the region through which the bypass air passes can be ensured to be free of contact with such collected water.

Figure 2:
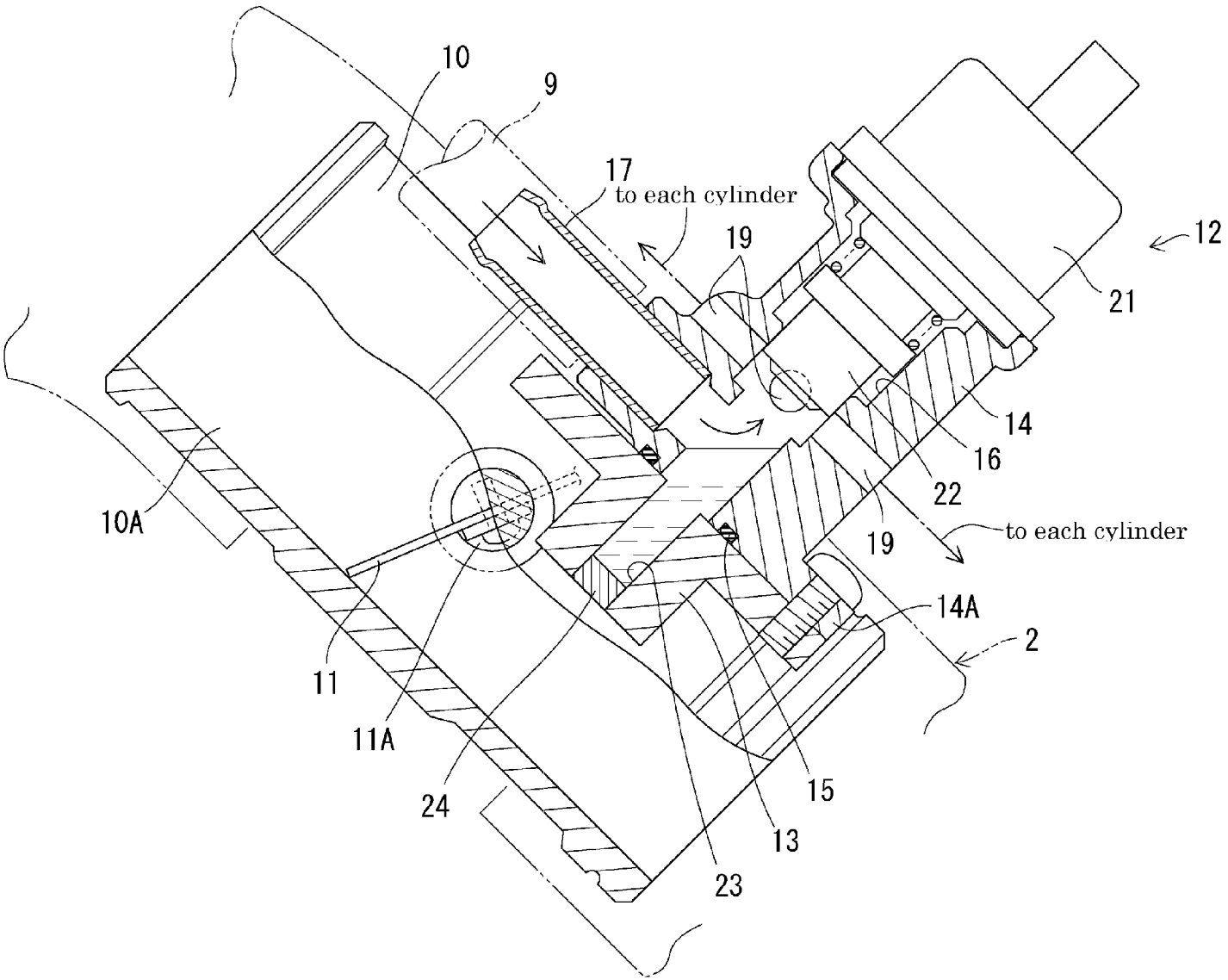
FIG. 2 is a section view illustrating an idle number-of-revolutions control device.
Figure 3:
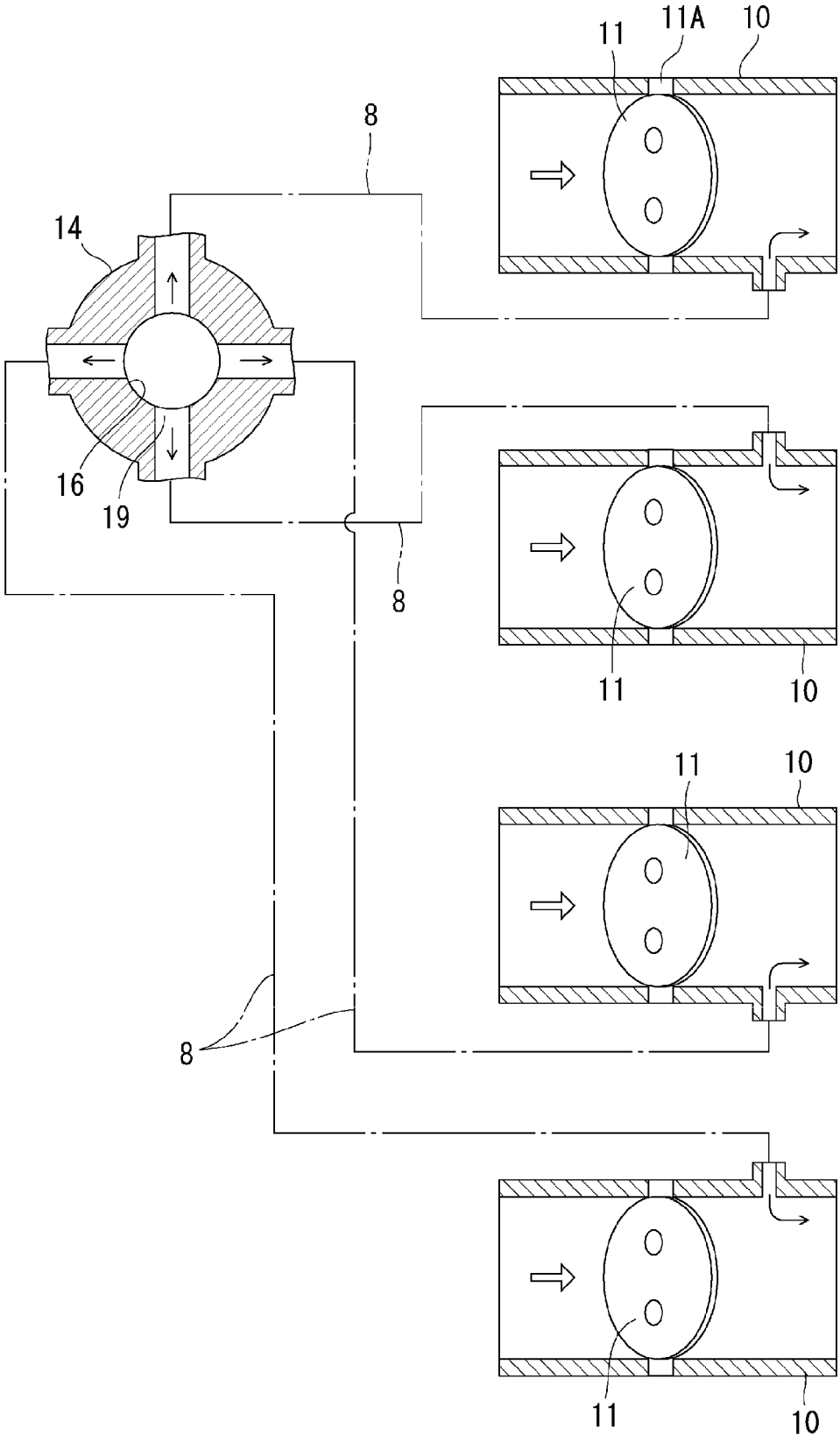
FIG. 3 is a section view of a measurement portion.

In this regard, a portion acting as the water collection portion in this preferred embodiment, as shown in FIG. 2, in a strict sense, preferably has an area substantially equal to a depth formed in the lower housing 13 plus a thickness of the flange portion 14A of the upper housing 14 side.

The air intake device of the first preferred embodiment is preferably constructed in the manner described above. At the time of idling the engine, the outside air is taken into the air cleaner 3 by a negative pressure produced in the cylinder. The outside air is filtered by the element 4 in the air cleaner 3 and enters the clean side chamber 6. A portion of the air passes through the bypass passage 8 and has its quantity measured by the ISC valve 21 and then is supplied to each cylinder. The ISC valve 21 displaces the plunger 22 in the axial direction on the basis of the publicly known control technique by the ECU (not shown) to control the opening of each outflow passage 19. In this manner, the engine is controlled, for example, such that, as the cooling water temperature of the engine decreases, the idle number of revolutions increases, whereby a warming-up time can be made shorter.

For example, when a vehicle runs on a snow covered path, the stirred-up snow and moisture can enter into the air cleaner. In this case, bypass air containing a large amount of moisture enters into the bypass piping 9 from the clean side chamber 6. The bypass air enters into the fitting hole 16 of the idle number-of-revolutions control device 12 from the inflow pipe 17, then changes its direction upward in the axial direction, passes through each outflow passage 19 being in a state where its opening is adjusted, and reaches the corresponding cylinder.

In this preferred embodiment, when the bypass air enters into the upper housing 14 of the idle number-of-revolutions control device 12, the bypass air impacts on a side opposite to the opening of the inflow pipe 17 in the hole wall of the fitting hole 16, such that, along with such a decrease in a flow rate that is caused by the direction change of the bypass air after the impact, water easily tends to adhere to the surface of the wall on which the bypass air impacts. The water adhering to the surface of the wall runs down along the inclination of the impact wall by the action of the gravity and is collected in the water collection portion. Thus, the bypass air has moisture removed in the upstream portion before the bypass air has its quantity measured by the ISC valve 21. Thus, this can prevent the possibility that the ISC valve 21 will cause an operating malfunction due to the water being frozen. Moreover, the water collection portion is disposed in a way to expand a portion of the bypass passage 8, so that as long as water is not excessively collected, it is not closed by the water. Thus, the operation of the idle number-of-revolutions control can be ensured.

Moreover, in this preferred embodiment, the water collection portion 23 is defined by the arrangement of the upper and lower housings 13, 14 of the idle number-of-revolutions control device 12. This eliminates the need for disposing an external member exclusively for collecting water. In particular, the lower housing 13 is formed integrally with the throttle body 10, which can contribute to a reduction in the number of parts. Further, the water collection portion 23, in a strict sense, is arranged so as to extend over the lower housing 13 and the flange portion 14A of the upper housing 14, which can contribute to an increase in the capacity of the water collection portion 23. Still further, the water collection portion 23 is arranged coaxially with the fitting hole 16 for fitting the ISC valve 21, so that the water collection portion 23 can be formed simultaneously at the time of performing the work of forming the fitting hole 16, and can thus be easily formed. In addition, in this preferred embodiment, the water collection portion 23 is positioned near the upper portion of the engine, so that water collected in the water collection portion 23 can be evaporated by the radiation heat from the engine. As a result, it is possible to reduce the capacity of the water collection portion 23. In addition, in this preferred embodiment, when the water collection portion 23 is disposed in the engine department covered with the bonnet B, the radiation heat of the engine remains in the engine department and hence facilitates the evaporation action of the water in the water collection portion 23. Thus, this can more effectively achieve a reduction in the size of the water collection portion 23.

Second Preferred Embodiment

Figure 4:
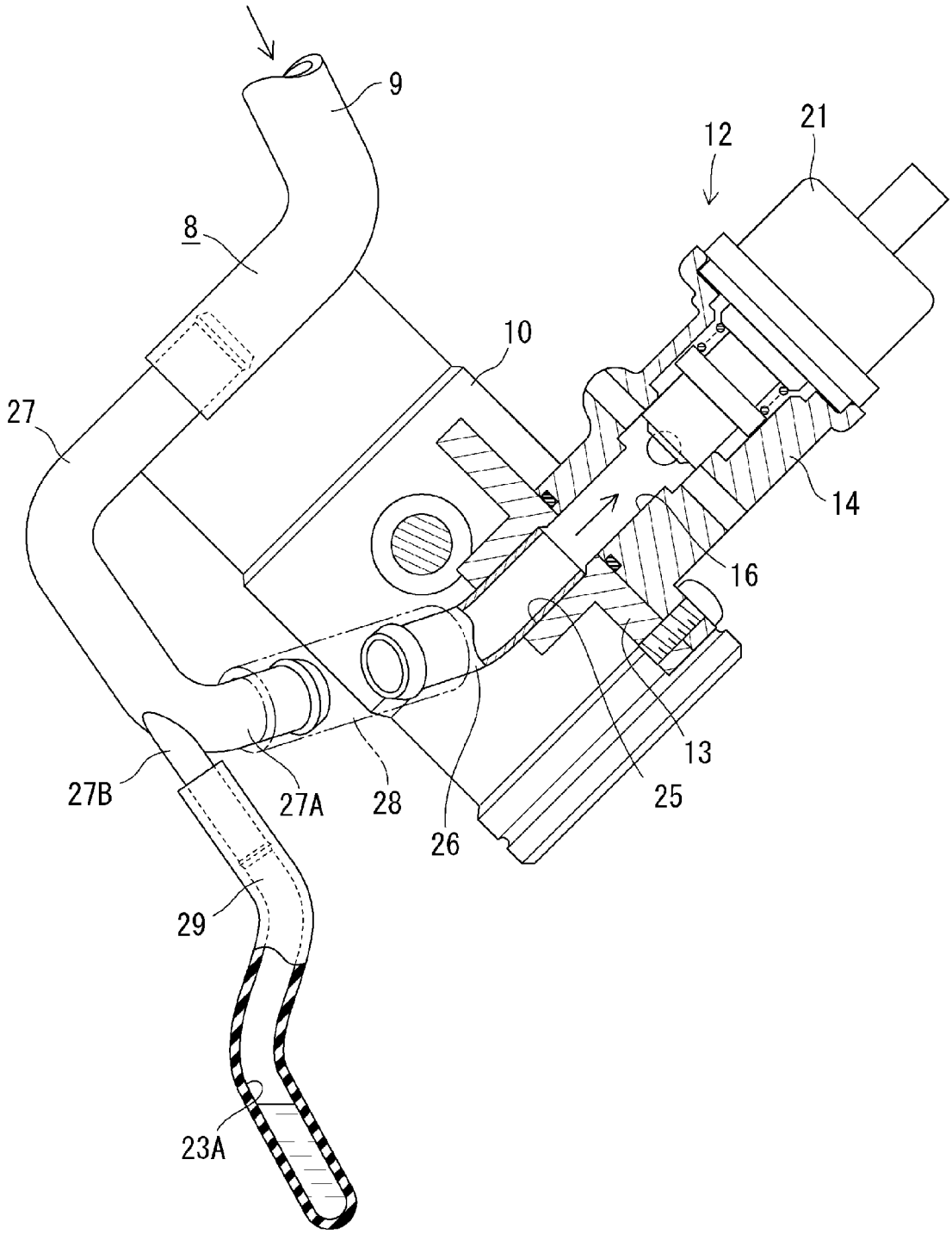
FIG. 4 is a section view of a main portion in a second preferred embodiment of the present invention.

Next, a second preferred embodiment of the present invention will be described with reference to FIG. 4. In the first preferred embodiment, the water collection portion 23 is provided in the housings 13, 14 of the idle number-of-revolutions control device 12, but in the second preferred embodiment, a water collection portion 23A is disposed outside the idle number-of-revolutions control device 12. That is, the lower housing 13 has a through hole 25 formed therein coaxially with the fitting hole 16, and the through hole 25 has an introduction pipe 26 inserted thereinto from below. The introduction pipe 26 protrudes downward from the lower housing 13 and is arranged to bend obliquely from its middle position.

On the other hand, the bypass piping 9 connected to the clean side chamber 6 of the air cleaner 3 extends obliquely downward and rearward and has air piping 27 connected to its end portion, the air piping 27 having its tip portion branched into two portions. One branch portion 27A of the air piping 27 is bent to the bent end side of the introduction pipe 26, and both of the branch portion 27A and the bent end side are connected to each other by a connection tube 28. The other branch portion 27B is directed obliquely downward and rearward and has a water storage tube 29 connected thereto in a nearly longitudinal position, the water storage tube 29 having a water collection portion 23A formed therein. The water storage tube 29 has a closed end and can be connected to the other branch portion 27B so as to be freely removed (but may be connected so as not to be removed) The water storage tube 29 is disposed at the lowest position between the connection pipe 7 of the air cleaner 3 and the idle number-of-revolutions control device 12 of the bypass passage 8.

The other features are preferably the same as in the first preferred embodiment. According to the second preferred embodiment, the water collection portion 23A is disposed at the lowest position in the upstream portion of the idle number-of-revolutions control device 12 of the bypass passage 8 and hence can automatically collect water in the bypass passage 8. Moreover, unlike the first preferred embodiment, the water collection portion 23A is formed separately from the idle number-of-revolutions control device 12 so as to branch the air piping 27. Thus, this can provide the advantage that the idle number-of-revolutions control device 12 is not forced to be changed to have a special structure. Further, since the water storage tube 29 can be removed, the water storage tube 29 can be also removed at an appropriate time for draining water. In this case, if the water storage tube 29 is formed of transparent material, the amount of collected water can be visually determined from the outside and hence the water can be drained from the water storage tube 29 at the appropriate time.

Third Preferred Embodiment

Figure 5:
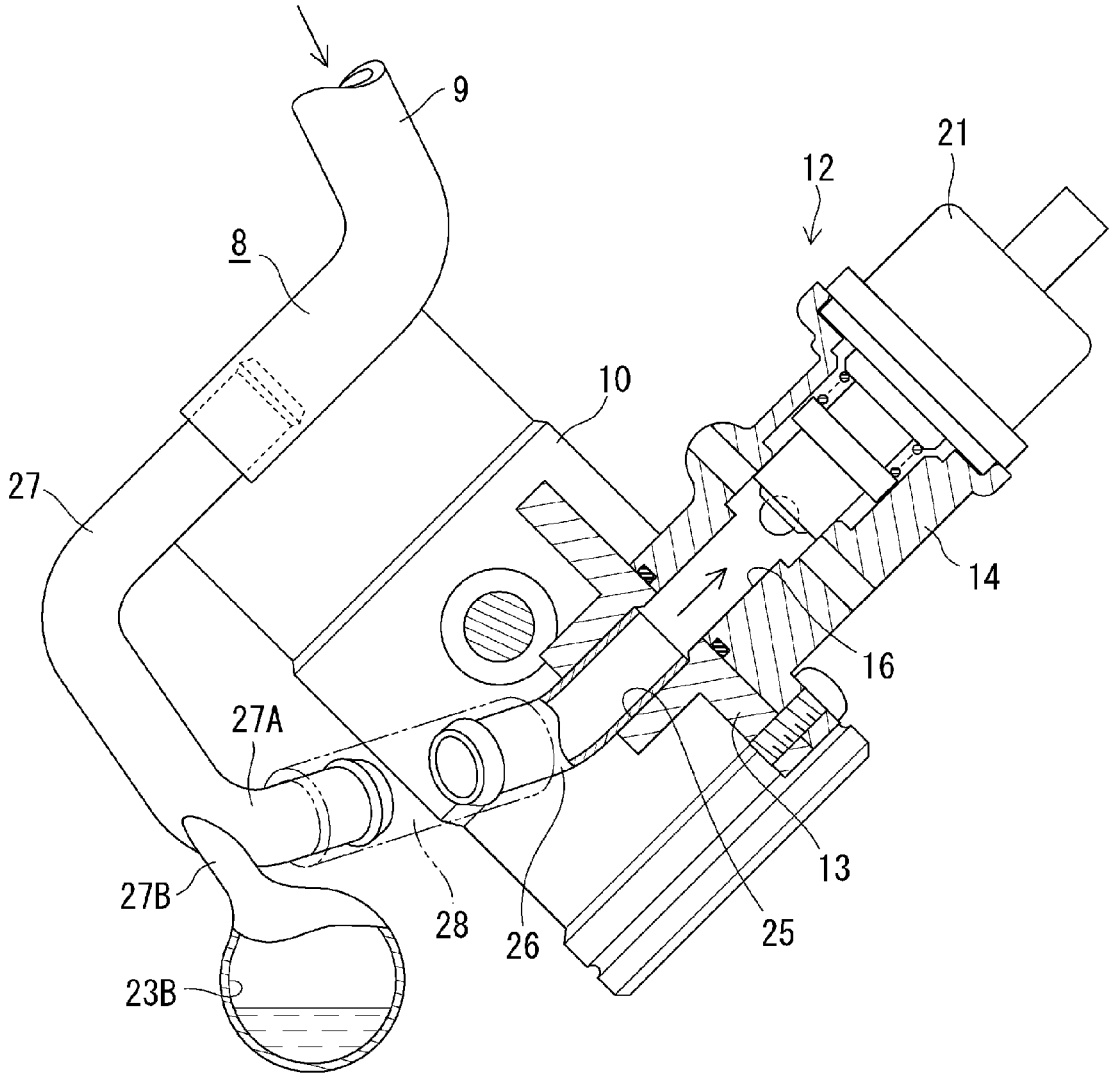
FIG. 5 is a section view of a main portion in a third preferred embodiment of the present invention.

Next, a third preferred embodiment of the present invention will be described with reference to FIG. 5. In the second preferred embodiment, the water collection portion 23A is preferably disposed in the water storage tube 29 that is a separate member from the air piping 27, but in the third preferred embodiment, the water collection portion 23A is preferably formed integrally with the air piping 27. A lower end of the other branch portion 27B in the air piping 27 preferably has a bulged, substantially spherical shape and has a water collection portion 23B formed therein. This water collection portion 23B, as in the second preferred embodiment, is also disposed at the lowest position between the connection pipe 7 of the air cleaner 3 and the idle number-of-revolutions control device 12 of the bypass passage 8. Thus, the water produced in the bypass passage 8 can be automatically collected in the water collection portion 23B. Here, the water collection portion 23B is disposed at a position comparatively close to the engine, so that the water in the water collection portion 23B is evaporated by the radiation heat from the engine.

Other Preferred Embodiments

The present invention is not limited to the preferred embodiments described above and with reference to the drawings, but for example, the following preferred embodiments are included in the technical scope of the present invention. Further, in addition to the following preferred embodiments, the present invention can be variously modified and put into practice without departing from the spirit and scope of the present invention.

In any one of the preferred embodiments described above, it has been described in which the present invention is preferably applied to the snowmobile, but the present invention can be widely applied to other vehicles such as a motorcycle or any other vehicles.

In the above preferred embodiments, it has been described in which the present invention is preferably applied to a four-cylinder engine, but it should be noted that the number of cylinders is not limited to four.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An air intake device for an engine, the air intake device comprising:

a throttle body located in an intake passage of the engine;

a bypass passage arranged to connect an upstream side and a downstream side of a throttle valve disposed in the throttle body;

an idle number-of-revolutions control device provided in the bypass passage and arranged to control a quantity of air passing through the bypass passage and flowing into the downstream side of the throttle valve according to a state of the engine; and a water collection portion located on an upstream side of the idle number-of-revolutions control device in the bypass passage and including a connection portion arranged to connect with the bypass passage.

2. The air intake device for an engine according to claim 1, wherein the water collection portion is arranged at a lowest portion in an upstream portion of the idle number-of-revolutions control device of the bypass passage.

3. The air intake device for an engine according to claim 1, wherein the water collection portion is disposed in a portion in a housing of the idle number-of-revolutions control device of the bypass passage.

4. The air intake device for an engine according to claim 3, wherein the water collection portion is located in a bent portion of the bypass passage in the housing.

5. The air intake device for an engine according to claim 3, wherein the idle number-of-revolutions control device is fitted to the throttle body, the water collection portion includes a first portion located on a housing side of the idle number-of-revolutions control device and a second portion connected to the first portion and located on a throttle body side.

6. The air intake device for an engine according to claim 3, wherein the idle number-of-revolutions control device includes a plunger arranged to move along an axial direction so as to measure a quantity of air to be supplied to an upstream side of the throttle valve, the housing has a fitting hole formed therethrough along an axial center from one end side of the housing, the fitting hole having the plunger provided therein, and the water collection portion has a recessed shape in a portion on an extension line of the fitting hole on a wall surface opposite to a tip of the plunger in the housing.

7. The air intake device for an engine according to claim 1, wherein a portion of the bypass passage on the upstream side of the idle number-of-revolutions control device includes air piping, and the water collection portion is branched from and located in a middle portion of the air piping.

8. The air intake device for an engine according to claim 1, wherein the water collection portion is positioned upstream of the engine.

9. The air intake device for an engine according to claim 1, wherein the engine is mounted in a vehicle, and the engine and the water collection portion are arranged under a cover defining an external surface of the vehicle.

* * * * *